US007524380B1

(12) United States Patent
Duri et al.

(10) Patent No.: US 7,524,380 B1
(45) Date of Patent: Apr. 28, 2009

(54) ENERGY EFFICIENT DISHWASHING

(75) Inventors: Sastry S. Duri, Yorktown Heights, NY (US); Jeffrey G. Elliott, Danbury, CT (US); Paul A. Moskowitz, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/183,254

(22) Filed: Jul. 31, 2008

(51) Int. Cl.
*B08B 3/02* (2006.01)
*B08B 7/02* (2006.01)

(52) U.S. Cl. ..... 134/18; 134/25.2; 134/57 D; 134/58 D

(58) Field of Classification Search ..... 134/10, 134/18, 25.2, 42, 57 D, 56 D, 58 D, 113, 134/200
See application file for complete search history.

(56) References Cited

U.S. PATENT DOCUMENTS 3,490,486 A * 1/1970 Cushing ..... 137/387
5,229,753 A * 7/1993 Berg et al. ..... 340/679
6,603,218 B1 8/2003 Aisa
6,622,754 B1 9/2003 Roth et al.
2007/0181162 A1 8/2007 Classen et al.

* cited by examiner

*Primary Examiner*—Michael Barr
*Assistant Examiner*—Saeed T Chaudhry
(74) *Attorney, Agent, or Firm*—Cantor Colburn LLP; Ken Corsello

(57) ABSTRACT

Disclosed is a method for controlling a dishwasher, including sensing weight, volume, and location of items disposed in dishwasher compartments, communicating sensed data to a controller, calculating duration of a washing and drying cycle and an amount of cleaning solution to be used based on the sensed data, implementing the washing and drying cycle for the length of time, wherein a smaller sensing of the weight and volume results in a shorter amount of time than would be spent based on a larger sensing of weight and volume, directing cleaning solution to each compartment, wherein any of the compartments including fewer or none of the items will receive less cleaning solution than any of the compartments including more items, transmitting efficiency data based on the calculating, implementing, commanding, and sensing to a viewable medium, and minimizing usage of electrical energy and water via the implementing, commanding, and transmitting.

1 Claim, 3 Drawing Sheets

ENERGY EFFICIENT DISHWASHING

BACKGROUND

The disclosure relates generally to energy efficient dishwashing, and more particularly to energy efficient dishwashing designed to minimize usage of electrical energy and water.

Over the years, dishwashers have become a great labor saving device. However, dishwashers employ the use of electricity and hot water to perform the task of washing dishes. Energy usage in the form of heated water and electrical energy coast the consumer money and results in release of greenhouse gases (GHG's) into the atmosphere. Water in general also has a cost, and is becoming a scarce commodity in drier regions. Accordingly, a dishwasher that could minimize usage of electrical energy and water would be desirable.

SUMMARY

Disclosed is a method for controlling a dishwasher in a energy efficient manner, the method including sensing weight, volume, and location of items disposed in each of a plurality of compartments of a dishwasher, the sensing being accomplished via a plurality sensors disposed in each of the plurality of compartments, wherein the sensing occurs prior to a start of a washing cycle and drying cycle, wherein the sensing further includes sensing at least one of electrical conductivity and transparency of a cleaning solution used in the dishwasher, communicating sensed data from the sensors to a controller; calculating a desired length of time for the washing cycle and the drying cycle based on the sensed data, and calculating a desirable amount of cleaning solution to be used in each of the plurality of compartments based on the sensed data, the cleaning solution including at least water and detergent, wherein the calculating further includes calculating for a desired temperature, detergent, and detergent ratio of the cleaning solution based on the sensed data, implementing the washing cycle and the drying cycle for the length of time, wherein a smaller sensing of the weight and volume results in a shorter amount of time than would be spent based on a larger sensing of the weight and volume, commanding the dishwasher to direct the amount of water and detergent to each compartment of the plurality of compartments, wherein any of the plurality of compartments sensed to include fewer or none of the items will receive less water and detergent than any of the plurality of compartments sensed to include more of the items, transmitting efficiency data from the controller to a medium viewable by a user, the efficiency data being based on the calculating, the implementing, the commanding, and the sensing of the weight, the volume, and the location of the items, wherein the transmitting includes suggesting movement of some of the items from one of the compartments to another of the compartments based on the sensing of the location of the items in the compartments, wherein the efficiency data includes at least one of a predicted cost at a present time and a predicted cost at a later time for the implementing and commanding, connecting the controller to an internal or external internet network and transmitting the efficiency data to a computing resource connected to the internet network, wherein the computing resource is the medium viewable by the user; minimizing usage of electrical energy and water via the implementing, commanding, and transmitting, and transmitting dishwasher control commands implemented by the user from the computing resource to the controller.

Also disclosed is a system for controlling a dishwasher in a energy efficient manner, the system including a plurality of compartments included with the dishwasher, sensors disposed in each of the plurality of compartments, the sensors being configured to sense weight, volume, and location of items disposed in each of a plurality of compartments of the dishwasher, a controller disposed in communication with the sensors, the controller being configured to receive sensed data from the sensors, the sensed data pertaining to sensed weight, sensed volume and sensed location of the items; wherein the controller is configured to implement a washing cycle and a drying cycle for a length of time based on the sensed data from the sensors, wherein a smaller sensing of weight and volume results in a shorter amount of time than an amount of time that would be spent based on a larger sensing of weight and volume, wherein the controller is also configured to command the dishwasher to direct an amount of cleaning solution including water and detergent to a desired compartment of the plurality of compartments based on the sensed data from the sensors, wherein any of the plurality of compartments sensed to include fewer or none of the items will receive less water and detergent than any of the plurality of compartments sensed to include more of the items, and a medium viewable by a user, the medium being disposed in communication with the controller in such a manner that efficiency data based on the sensed data is transmittable from the controller to the medium.

BRIEF DESCRIPTION OF THE SEVERAL VIEWS OF THE DRAWINGS

The foregoing and other features and advantages of the present invention should be more fully understood from the following detailed description of illustrative embodiments taken in conjunction with the accompanying Figures in which like elements are numbered alike in the several Figures.

DETAILED DESCRIPTION

Figure 1:
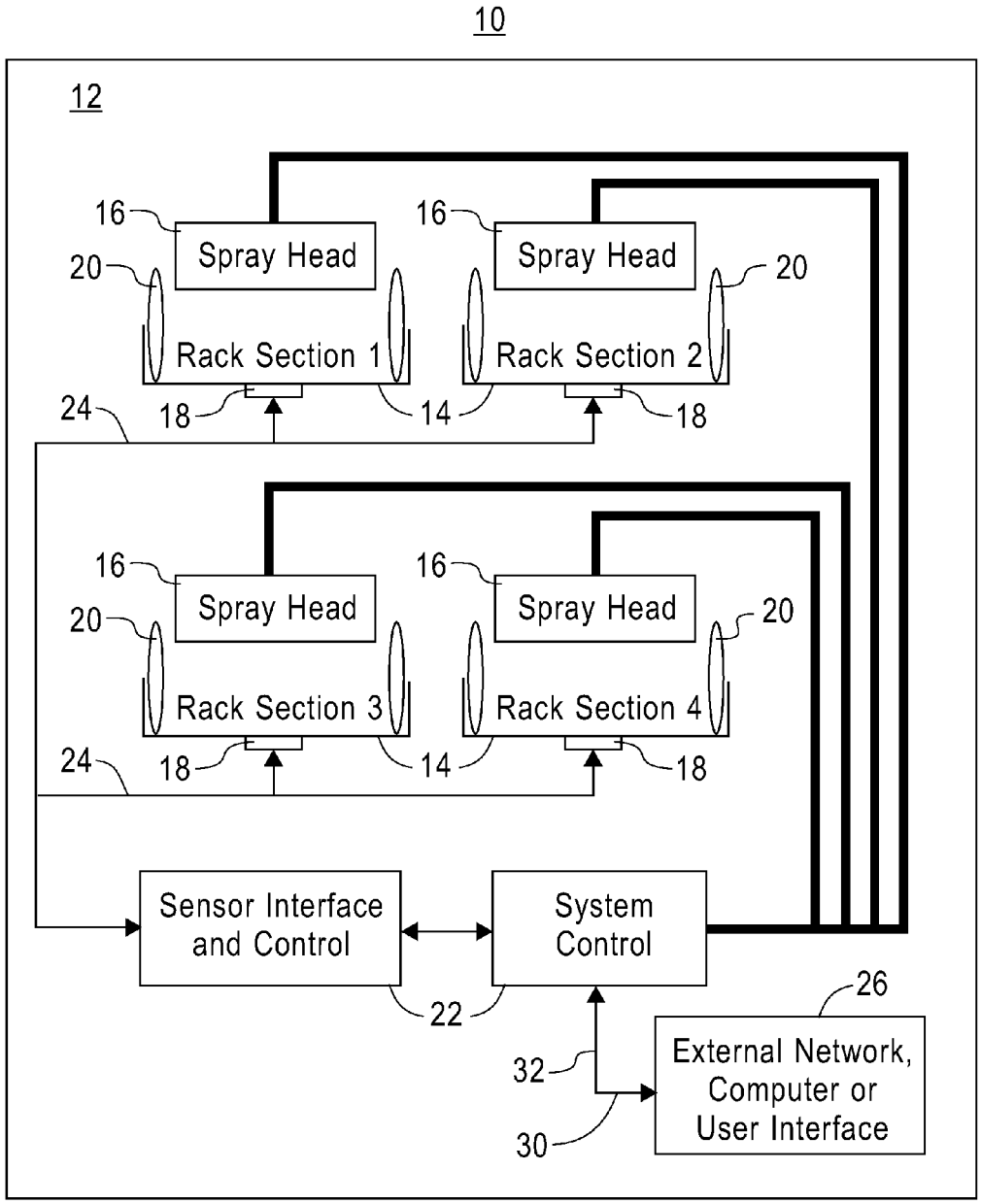
FIG. 1 is a schematic representation of a system for controlling a dishwasher in an energy efficient manner.

Referring to FIG. 1, a system 10 for controlling a dishwasher 12 in an energy efficient manner is illustrated. As is shown in the Figure, the dishwasher 12 includes a plurality of rack sections or compartments 14 disposed in proximity to spray heads 16. Each of these compartments 14 includes one or more sensors 18, which sense for weight, volume, and location/presence of items 20 disposed in the compartments 14. Sensors 18 such as but not limited to load cells for weight detection, optical sensors for volume detection, and/or cameras and electrical capacitance sensors for determining item presence in the various compartments 18 (the capacitance sensors indicating presence of an item 20 when capacitance changes), may be employed in the system 10. Each of the sensors 18 is disposed in communication with a controller 22, which is configured to receive sensed data 24 from the sensors 18. Of course, the sensed data 24 pertains to the weight, volume, and location/presence of items 20 as sensed by the sensors 18. The system 10 further includes a medium 26 that is viewable by a user and disposed in communication with the controller 22. The manner in which these components work together to control the dishwasher 12 in an energy efficient manner (i.e. a manner that minimizes usage of electrical energy and water) will now be discussed in detail.

Figure 2:
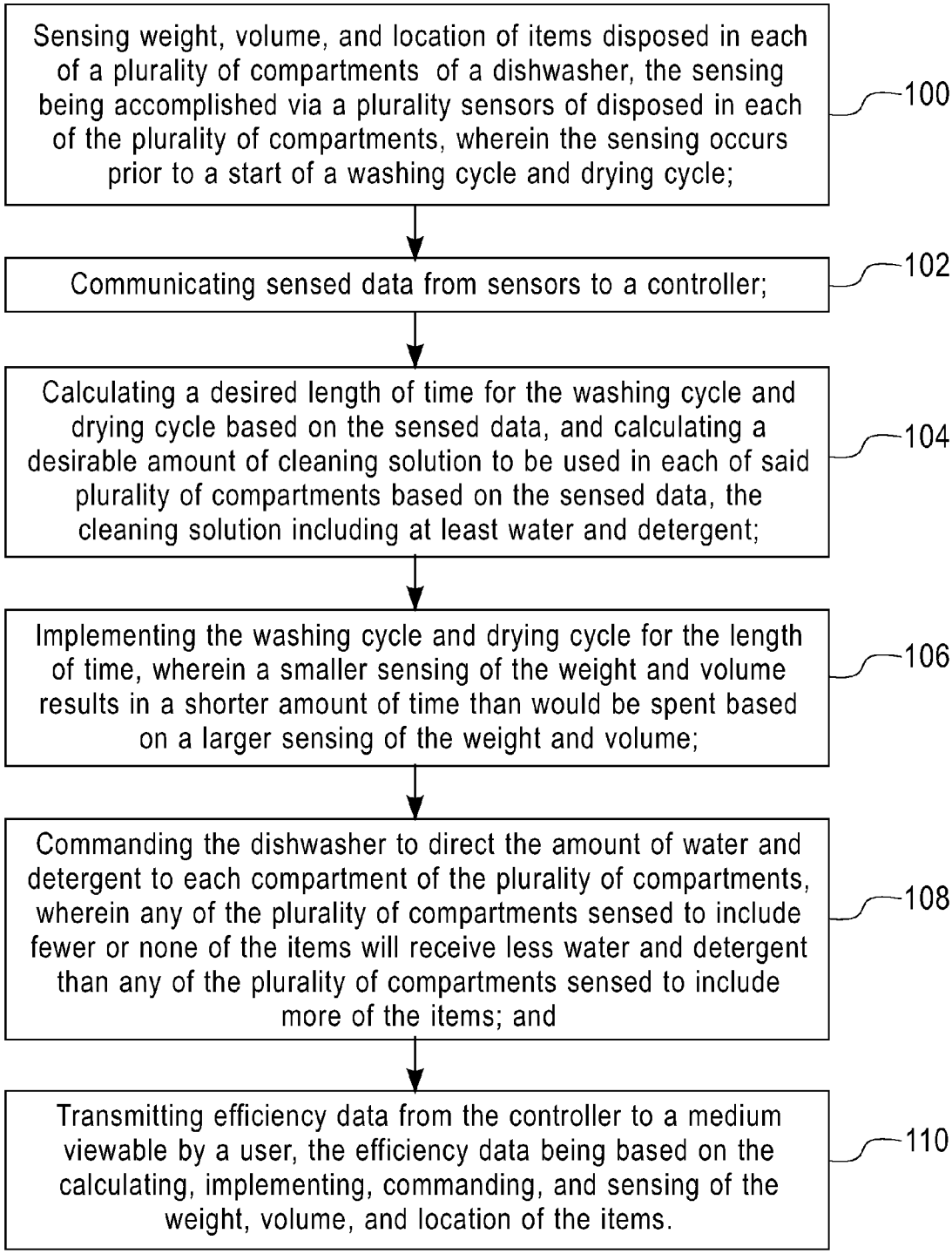
FIG. 2 is a block diagram illustrating a method for controlling a dishwasher in an energy efficient manner.

Referring to operational block 100 of FIG. 2, the above-discussed sensing by the sensors 18 occurs prior to the start of any washing or drying cycle in the dishwasher 12. Following this sensing, the sensed data 24 is communicated to the controller 22, as shown in operational block 102. As is shown in operational block 104, the controller 22 then analyzes the data 24 and calculates a desired length of time for a washing cycle and drying cycle, as well as a desirable amount of cleaning solution (including at least water and detergent) to be used in each of the compartments 14, based on the sensed data 22. Referring to operation blocks 106 and 108, the controller 22 then implements and commands the dishwasher based on the below discussed calculations.

With regards to the washing and drying cycle, the controller 22 is configured to calculate and implement based on sensed weight and volume data contained in the sensed data 24. For example, if the weight and volume of the items 20 in the compartments 14 are sensed to be relatively small, the controller 22 will implement washing and drying cycles that take a relatively shorter amount of time. On the contrary, if the weight and volume of the items 20 in the compartments 14 are sensed to be relatively large, the controller 22 will implement washing and drying cycles that take a relatively longer amount of time. In this manner, large loads of items 20 to be washed receive longer wash and dry cycles than smaller loads of items 20 to be washed. This shortening of cycle time based on load size allows the system 10 to use only the amount of water and detergent necessary for a particular load, thus saving water and detergent when loads are in a relatively smaller range.

With regards to the individual compartments 14, the controller 22 is also configured to calculate and direct based on data pertaining to item presence, which is also contained in the sensed data 24. For example, if a particular compartment 14 is sensed to include fewer items 20 than another compartment 14, the controller 22 will command the spray heads 16 to direct less water and detergent to the compartment 14 with fewer items 20 than the compartment 14 with more items 20. In this manner, individual compartments with larger loads of items 20 to be washed receive more water and detergent than individual compartments 14 smaller loads of items 20 to be washed. This compartment specific direction of water and detergent based on sensed data 24 allows the system 10 use only an amount of water and detergent necessary to a specific compartment 14, thus saving water and detergent in compartments 14 with smaller item loads.

Referring now to operational block 110, efficiency data 30 is also transmitted from the controller 22 to the viewable medium 26. This data 30 is calculated by the controller 22 based on the calculating, implementing, commanding, and sensing discussed above. For example, if one of the compartments 14 has been sensed to have a large load of items, while another of the compartments 14 has no items, the controller 22 may calculate and transmit efficiency data 30 that indicates this condition to the viewable medium 26. In such an instance, the data 30 may indicate the imbalance in the compartments 18, and suggest moving items 20 from one compartment to another. The data 30 may also provide notification that more water and detergent will be directed to the larger load. The data 30 may additionally include indications of detergent levels and/or needs in the dishwasher 10.

Once received by the viewable medium 26, the efficiency data 30 is displayed to the user before, during, or after, any washing or drying cycle. The medium 26 may be any external display such as a graphic user interface disposed on the dishwasher, computer, and/or internal or external internet network to which the controller 22 is connected. Of course, a user may also send dishwashing commands 32 to the controller 22 from the viewable medium 26, wherein the dishwashing commands 32 may override any controller calculations based on sensed data 24.

In addition to the above, it should be noted that the sensors 18 may also comprise electrical conductivity or transparency sensors that are configured to monitor dissolved materials or particles in the cleaning solution. By monitoring the cleaning solution for such particles, a level of item cleanliness may be sensed and passed on to the controller 22 in the sensed data 24. This data may be used by the controller 22 to calculate and adjust a washing/rinsing cycle in terms of solution temperature, time duration, type of detergent, and detergent-to-water ratio in the cleaning solution.

It should be additionally noted that liquids or fluids other than water may be used in the washing/rinsing cycle. For example, when clean portable water is in short supply, salt water may be used during some of the washing/rinsing cycle. Also, an alcohol pre-wash may be employed to reduce an amount of hot water needed for cleaning.

Figure 3:
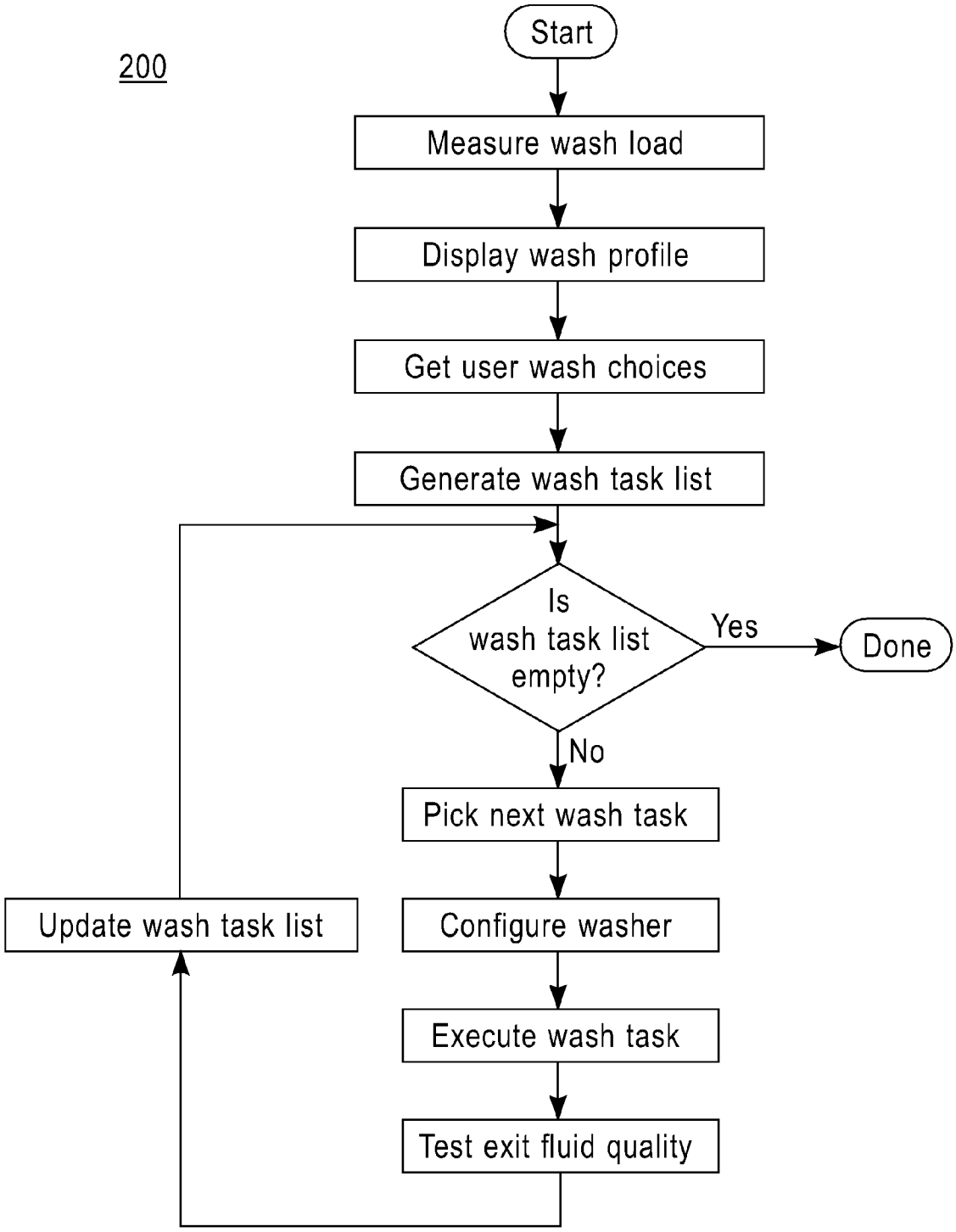
FIG. 3 is flow chart illustrating high level control logic employed by the system for controlling a dishwasher in an energy efficient manner.

Referring now to FIG. 3, a flow chart illustrating high level control logic program 200 employed by the system controller 22 is illustrated. The program 200 starts when a user loads the dishwasher 12 and presses a start button. At this point the program 200 determines a desired washing and drying cycle based on the sensed data 24 discussed in the preceding paragraphs. Then, via the viewable medium 26 to which the controller 22 is communicated, the program 200 presents the user with a profile of the desired (and now impending) washing and drying cycles. In addition to cycle duration, temperature, detergent type, and compartmental direction/concentration of cleaning solution, this profile may include predicted energy and cost efficiency for cycles run at this or a later time, as well as at different levels of cleanliness. The program then collects user input (if any), which is received at the viewable medium 26 and transmitted to the controller 22. Next, based on the sensed data 24 and user input, the program 200 generates a wash task list, the steps of which being implemented until the list is completed. During implementation of each step of the task list, the program goes through a process of picking a task to be completed, configuring the dishwasher 12 to execute the task, and executing the task. Once the list is completed, the program 200 stops operation of the dishwasher. It should be noted that the program may monitor the condition of the wash fluid to determine cleanliness at any point during implementation of the task list. This is done via the electrical conductivity or transparency sensors discussed above. Of course, the task list may then be modified based on this determined cleanliness.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A method for controlling a dishwasher in a energy efficient manner, the method comprising:

sensing weight, volume, and location of items disposed in each of a plurality of compartments of the dishwasher, said sensing being accomplished via a plurality sensors disposed in each of said plurality of compartments, wherein said sensing occurs prior to a start of a washing cycle and drying cycle, wherein said sensing further includes sensing at least one of electrical conductivity and transparency of a cleaning solution used in the dishwasher;

communicating sensed data from said sensors to a controller;

calculating a desired length of time for said washing cycle and said drying cycle based on said sensed data, and calculating a desirable amount of said cleaning solution to be used in each of said plurality of compartments based on said sensed data, said cleaning solution including at least water and detergent, wherein said calculating further includes calculating for a desired temperature, detergent, and detergent ratio of said cleaning solution based on said sensed data;

implementing said washing cycle and said drying cycle for said length of said time, wherein a smaller sensing of said weight and said volume results in a shorter amount of time than would be spent based on a larger sensing of said weight and said volume;

commanding said dishwasher to direct said amount of said water and said detergent to each compartment of said plurality of compartments, wherein any of said plurality of compartments sensed to include fewer or none of said items will receive less of said water and detergent than any of said plurality of compartments sensed to include more of said items;

transmitting efficiency data from said controller to a medium viewable by a user, said efficiency data being based on said calculating, said implementing, said commanding, and said sensing of said weight, said volume, and said location of said items, wherein said transmitting includes suggesting movement of some of said items from one of said compartments to another of said compartments based on said sensing of said location of said items in said compartments, wherein said efficiency data includes a predicted cost for said implementing and said commanding;

connecting said controller to an internal or external internet network and transmitting said efficiency data to a computing resource connected to said internet network, wherein said computing resource is said medium viewable by said user;

minimizing usage of electrical energy and said water via said implementing, said commanding, and said transmitting; and transmitting dishwasher control commands implemented by said user from said computing resource to said controller.

* * * * *